United States Patent [19]

Thaxton

[11] 4,337,831

[45] Jul. 6, 1982

[54] FIRE EXTINGUISHING APPARATUS FOR OIL WELLS

[76] Inventor: Darrel G. Thaxton, P.O. Box 201, Athens, La. 71003

[21] Appl. No.: 128,065

[22] Filed: Mar. 7, 1980

[51] Int. Cl.[3] ..... A62C 35/12

[52] U.S. Cl. ..... 169/69; 169/14; 166/364; 251/322

[58] Field of Search ..... 169/69, 46, 47, 18, 169/16, 74, 89, 5, 9, 14, 76; 166/364, 363, 90; 220/366, 367, 373; 251/322

[56] References Cited

U.S. PATENT DOCUMENTS

| | | | |
|---|---|---|---|
| 1,674,427 | 6/1928 | Freygang | 169/89 |
| 2,860,856 | 11/1958 | Bauer | 169/14 |
| 2,988,151 | 6/1961 | Dion-Biro | 169/14 |
| 3,092,183 | 6/1963 | Guise et al. | 169/74 |
| 3,589,446 | 6/1971 | Bower | 169/89 |
| 4,069,873 | 1/1978 | McClure | 169/16 |

FOREIGN PATENT DOCUMENTS

| | | | |
|---|---|---|---|
| 46203 | 1/1911 | Fed. Rep. of Germany | 169/69 |

*Primary Examiner*—Robert J. Spar
*Assistant Examiner*—Kenneth Noland
*Attorney, Agent, or Firm*—Sughrue, Mion, Zinn, Macpeak & Seas

[57] ABSTRACT

A fire extinguishing apparatus for oil wells has a plurality of containers for containing fire extinguishing material connected to a main fire extinguishing container. The main fire extinguishing container has a conduit leading from a valve in the neck thereof to the interior of a bell nipple positioned on an oil well blow out preventor. A bracket attached to the main container supports a manually operable spring loaded mechanism which is adapted, upon release of the spring loaded plunger contained therein, to open a valve in the neck of the main container and allow the content of the several containers to flow under pressure through conduits into the interior of the bell nipple thus extinguishing a fire therein. An additional valved line is attached to the bell nipple at one end thereof with the opposite end connected to a source of fire extinguishing materials located at a remote area onshore so that if the manually operable spring loaded mechanism cannot be operated on the oil well platform, then the source of fire extinguishing material at the remote location may be operated so as to cause fire extinguishing materials to flow through the additional valved conduit into the interior of the bell nipple extinguishing a fire therein.

9 Claims, 4 Drawing Figures

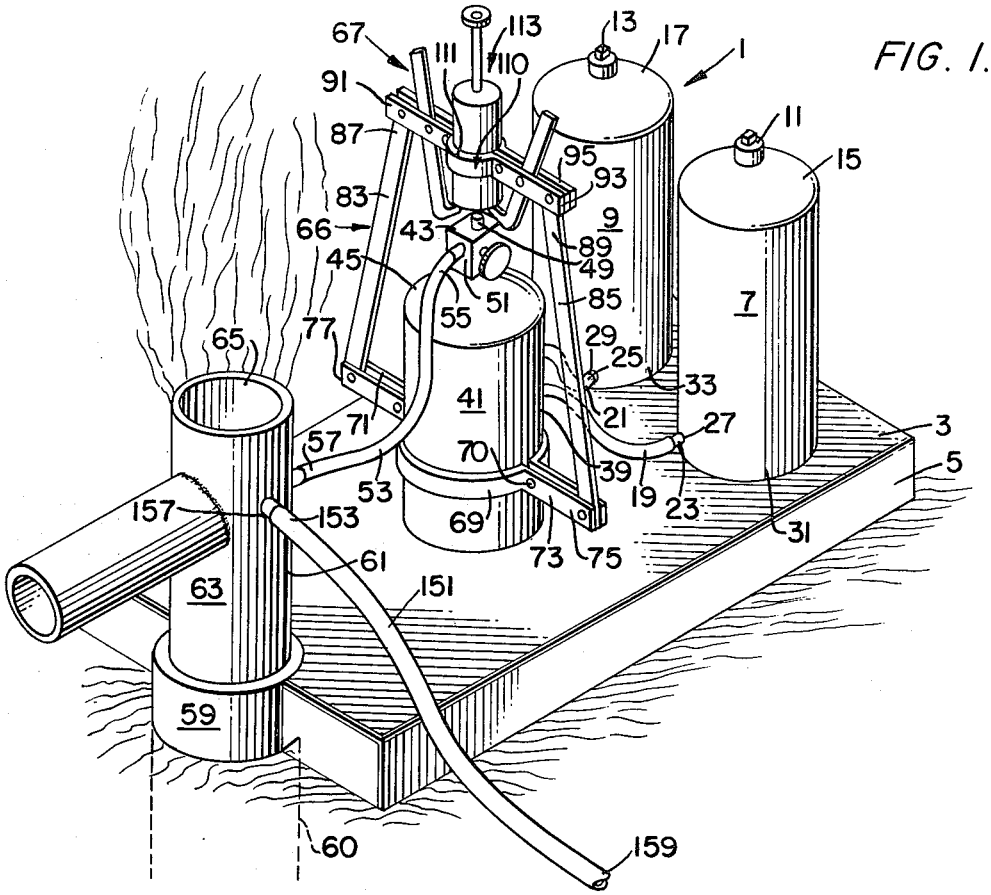
FIG. 1.
FIG. 2.
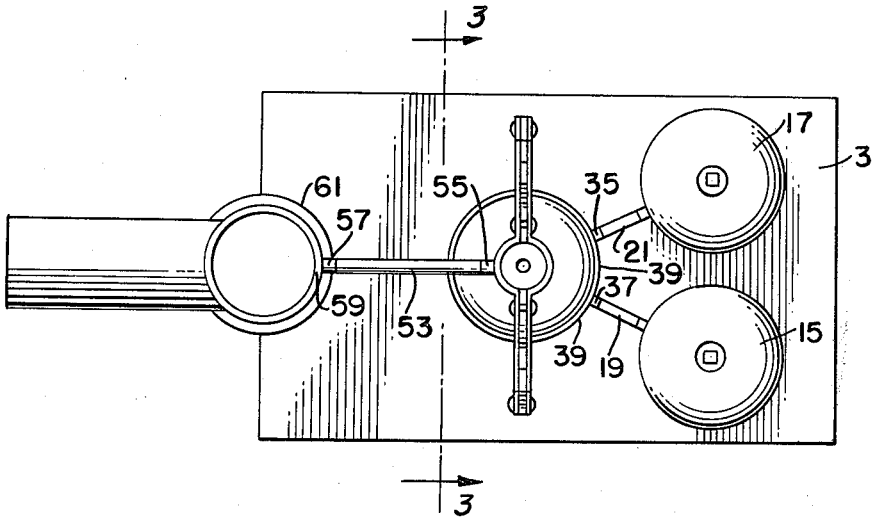

FIRE EXTINGUISHING APPARATUS FOR OIL WELLS

BACKGROUND OF THE INVENTION

1. Field of the Invention

This invention pertains to a fire extinguishing apparatus for use at oil well sites on land or on offshore oil well platforms. The fire extinguishing apparatus of this invention has a plurality of containers containing fire extinguishing material under pressure connected by conduits to a main fire extinguishing container. The main fire extinguishing container has a conduit leading from a valve in the neck thereof to the interior of a bell nipple which is located on a blow out preventor of an oil well. A manually operable spring loaded mechanism is provided to actuate the valve in the neck of the main container in the event of a fire in the interior of the bell nipple. An additional valved conduit connects the interior of the bell nipple to a source fire extinguishing material located at a remote location onshore. Upon manual release of the spring loaded mechanism, the valve in the neck of the main fire extinguishing container is opened to permit fire extinguishing material in the several containers to flow under pressure to the interior of the bell nipple thus extinguishing a fire therein. In the event that the apparatus on the platform cannot be actuated, a source of fire extinguishing material onshore may be actuated so that fire extinguishing material under pressure may flow through the additional valved conduit to the interior of the bell nipple extinguishing a fire therein.

2. Statement of the Prior Art

Prior developments in this field are shown, by way of general illustration, in the following list of patents:

D. S. Miller; U.S. Pat. No. 3,804,175; Apr. 10, 1974
G. W. Wiseman; U.S. Pat. No. 3,782,474; Jan. 1, 1974
G. H. Menge; U.S. Pat. No. 3,763,936; Oct. 9, 1973
B. W. Wiseman; U.S. Pat. No. 3,620,299; Nov. 16, 1971

SUMMARY OF THE INVENTION

This invention pertains to fire extinguishing apparatus for use on oil wells either on land or on offshore platforms.

It is an object of the present invention to provide a fire extinguishing apparatus which will be simple to construct, easy to install and effective in its fire extinguishing capabilities.

It is another object of the present invention to provide a fire extinguishing apparatus which will be manually operable at the oil well site or operable from a remote location onshore away from a floating platform.

It is a further object of the present invention to provide a fire extinguishing apparatus which will have a plurality of containers containing fire extinguishing material under pressure connection by valved conduit means to the interior of a bell nipple which is located on top of a blow out preventor of an oil well casing so that when the manually operable spring loaded meachanism is released, valving in the neck of the main fire extinguishing container is released thus permitting the fire extinguishing materials contained within the several containers to flow under pressure to the interior of the bell nipple extinguishing a fire therein.

A further object of this invention is to provide additional conduit means connected to the interior of the bell nipple at one end and at the other end to a source of fire extinguishing material at a remote area onshore for the purpose of conveying fire extinguishing materials under pressure from the remote location to the interior of the bell nipple extinguishing a fire therein.

Other and further objects of the present invention will become apparent to those skilled in the art from a consideration of the following specification when read in conjunction with the annexed drawings.

BRIEF DESCRIPTION OF THE DRAWINGS

FIG. 1 is a perspective view of the fire extinguishing apparatus of the present invention connected to a bell nipple which is attached to a blow out preventor of an oil well.

FIG. 2 is a plan view of the fire extinguishing apparatus connected to the bell nipple.

DETAILED DESCRIPTION OF THE INVENTION

Figure 3:
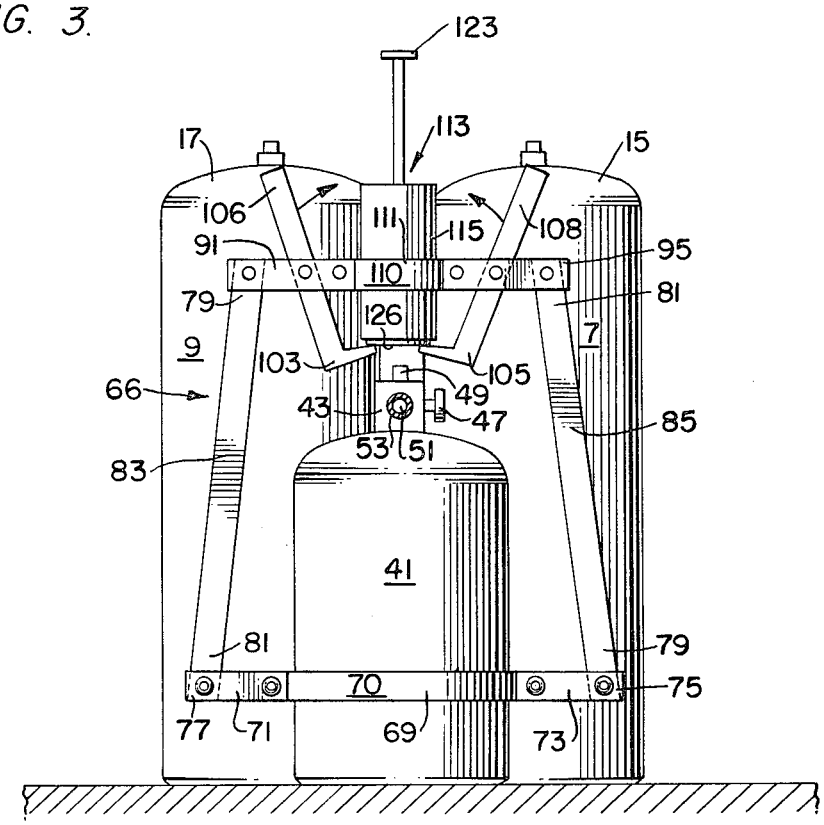
FIG. 3 is a front end view taken along the line 3—3 of FIG. 2.

Referring in more detail to the drawings, in FIGS. 1–2 numeral 1 represents a fire extinguishing apparatus having a platform 3 with a skirt 5 depending from the platform on all sides thereof. A plurality of containers 7 and 9 for holding fire extinguishing material under pressure are secured to the platform 3 by any suitable means. Containers 7 and 9 have rotatable closure means 11 and 13 on the tops 15 and 17 thereof. Conduits 19 and 21 are connected at their ends 23 and 25 to apertures 27 and 29 in the lower extremities 31 and 33 of the containers 7 and 9 exposing the interior of the containers to the conduits.

The opposite ends 35 and 37 of conduits 19 and 21 are connected to apertures (not shown) in the side 39 of main fire extinguishing container 41 exposing the interior of the main container to the conduits. Conduits 19 and 21 have check valve means (not shown) at their ends connecting to the main container 41 to prevent fire extinguishing materials under pressure in containers 7 and 9 from flowing into the main container 41 during inactive conditions.

Figure 4:
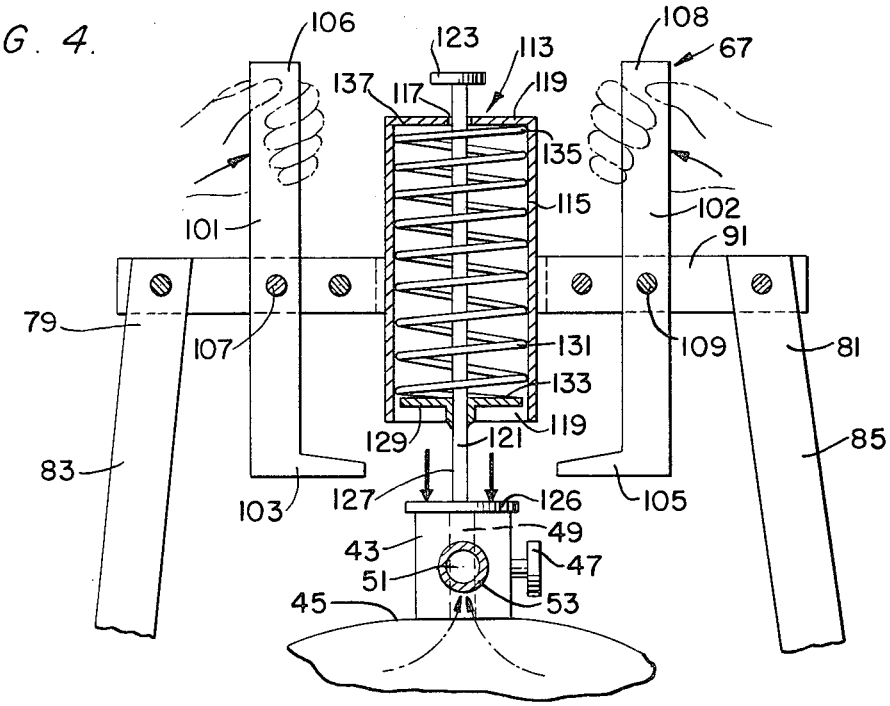
FIG. 4 is an expanded view in vertical section showing a manually operable mechanism and a spring loaded valve actuating mechanism.

Main container 41 is secured to platform 3 by any suitable means and is generally located somewhat off-center of the platform to provide a balance effect between it and the plural containers 7 and 9. The main container 41 has a valve 43 secured to the neck (not shown) at the top 45 of the container, FIG. 4. Valve 43 has a manually adjustable knob 47 screw-threaded therein for securing the valve to the neck of the container. The valve 43 has a vertically reciprocable plunger 49 therein, FIGS. 2–3, which when actuated downwardly permits free flow of the fire extinguishing material contained in the several containers to flow through the valve outlet 51. A conduit 53 is connected to the outlet 51 of the valve at one end 55 and at the opposite end 57 to an aperture (not shown) in the side 61 of a bell nipple 63 exposing the interior of the bell nipple to the conduit. The bell nipple 63 is attached at one end to a blow out preventor 59 which is attached to a well casing 60. The conduit 53 permits fire extinguishing material to flow under pressure from the several containers 7, 9 and 41 to the interior 65 of the bell nipple 63 upon actuation of the valve where said material extinguishes a fire therein.

A bracket 66 is secured to the main container by looped portions 69 formed in bars 71 and 73 having end extensions 75 and 77 extending outwardly from the looped portions. The looped portions fit around the main container and are secured together by fastening means 70.

Vertically upwardly extending rods 83 and 85 are attached at one end to extensions 75 and 77. The opposite ends 87 and 89 of the vertically upwardly extending rods are attached to cross-bar 91.

The cross-bar 91 is in the form of a pair of rods 93 and 95 the ends of which straddle the ends 87 and 89 of the rods 83 and 85. The rods 93 and 95 each have looped central portions 110 such that when the rods are secured together a band 111 is formed which supports housing 115 of the valve operating mechanism 113. Manually operable levers 101 and 102, FIG. 4, having handles 106 and 108 and horizontal foot members 103 and 105 are secured between rods 93 and 95, FIG. 1, for pivotal movement therebetween by pintles 107 and 109, FIG. 4. The band 111 formed by loops 110 in the rods 93 and 95 securely hold in vertical position above the valve a spring loaded mechanism 113, FIGS. 3–4.

The spring loaded mechanism 113 has a cylindrical housing 115 having an opening 117 in the top wall 119 thereof and an open bottom 119. A plunger rod 121 reciprocal within the openings 117 and 119 has a disc-like stop member 123 at one end, a second disc-like member 126 at the opposite end and a third intermediate disc-like member 129 secured to the plunger rod 121 adjacent to but spaced from disc 126 by suitable means. The disc-like members 126 and 129 are of smaller diameter than the bottom opening 119 of the cylindrical housing 115 whereby when the plunger rod 121 is raised vertically of the cylindrical housing the discs 126 and 129 enter into the housing through the opening 119. A spring 131 within the housing encircles the plunger rod 121 and has end 133 secured to the disc 129 at one end thereof and secured at the opposite end 135 to the interior surface 137 of top wall 119.

When the plunger rod 121 is raised vertically with respect to the cylindrical housing 115, the spring is compressed between disc 129 and the surface 137 of top wall 119. When the disc 126 enters the opening 119 of cylindrical housing 115 the manually operable levers 101 and 102 are pivoted on their pintles so that the foot members 103 and 105 extend across the opening 119. In this position, the foot members 103 and 105 extend across opening 119 to retain the discs 126 and 129 within the cylindrical housing thus maintaining the spring 131 in compressed condition and the plunger 121 in raised or cocked position.

In the event of a fire within the bell nipple 63, an oil well operator forces the handles 106 and 108 of levers 101 and 102 toward each other withdrawing the foot-member 103 and 105 from beneath the disc 126 thus releasing the spring loaded plunger 121. The disc 126 which is attached to the end of the plunger 121 descends rapidly and with considerable force until it strikes valve plunger 49 driving it downwardly thus actuating the valve 43 permitting fire extinguishing material under pressure to flow from the several containers through the valve and conduit 53 to the interior 65 of the bell nipple 63. When the valve in the main container 41 is actuated the valving in the ends of conduits 19 and 21 are also actuated open to release the pressurized contents of the plural containers 7 and 9 to flow into the main container 41, then through valve 43, and conduit 53 into the interior 65 of the bell nipple 63 thus extinguishing a fire therein.

As an additional and safety feature of the present invention, an additional conduit 151, FIG. 1, is attached at one end 153 thereof to an aperture 157 in the side 61 of the bell nipple 63. The opposite end of the conduit 151 is attached to a source of fire extinguishing material located at a remote area onshore in the case of an offshore drilling operation. A similar fire extinguishing apparatus as contemplated by this invention may be used and operated to cause fire extinguishing material to flow under pressure through the conduit 151 to the interior of the bell nipple thus extinguishing a fire therein. Alternatively, a different apparatus may be used at the remote area to furnish fire extinguishing material under pressure to flow through the additional conduit to the interior of the bell nipple.

The foregoing description is considered illustrative only of the principle embodiments of the invention. Numerous modifications and changes may readily occur to those skilled in the art to which this invention pertains without departing from the spirit and scope of the invention.

What I claim is:

1. A fire extinguishing apparatus for oil wells comprising:

a platform having a depending skirt therearound;

a plurality of containers secured to the platform;

a main container having a neck thereon secured to the platform adjacent to the plurality of containers;

valve means attached to the neck of said main container;

plunger means within said valve means to actuate same;

bracket means on said main container;

spring loaded valve actuating means supported on said bracket means above said plunger means of said valve;

means secured to said bracket means having means for maintaining said spring loaded plunger means in compressed condition;

conduit means attached at one end to said valve means and at the opposite end to a bell nipple which is attached to a blowout preventor of the oil well casing;

conduits connecting said plurality of containers to said main container; and additional valved conduit means attached at one end to the bell nipple and at the opposite end to a source of fire extinguishing material under pressure located at a remote location.

2. A fire extinguishing apparatus for oil wells as defined in claim 1, wherein:

said bracket means comprising a first pair of bars having looped center portions having end extensions extending from the looped portions, said bars secured together such that the looped center portions encircle and tightly grip the main container;

vertically extending rods attached at their ends to the end extensions of said first pair of bars, the opposite ends of said rods terminating above the main container;

a second pair of bars, similarly constructed as the first pair of bars, attached to the opposite ends of the vertically extending rods and looped portions of said rods encircling and firmly gripping a valve actuating spring loaded mechanism supported by said bracket means above said valve;

lever means pivotally secured between said second pair of bars, said lever means having handles at one end thereof and horizontal foot-members at the opposite ends; and said horizontal foot-members operable to maintain said spring loaded valve actuated means in compressed condition.

3. A fire extinguishing apparatus for oil wells as defined in claim 1, wherein:

said valve means attached to the neck of said main container comprising a valve housing;

means for securing said valve housing to the neck of the main container;

valve actuating plunger means reciprocal within said valve having an end extending from the valve during inactive conditions; and means for connecting the ends of said conduit means to said valve and to said bell nipple so that upon actuation of said valve by said actuating plunger means fire extinguishing material flows under pressure through said conduit to the interior of said bell nipple.

4. A fire extinguishing apparatus for oil wells as defined in claim 1, wherein:

said spring loaded valve actuating means comprises:

a housing;

a top wall having an opening therein, said top wall having an inside surface;

an open bottom;

a valve actuating plunger having a stop disc at one end thereof, a valve actuating disc at the opposite end and an intermediate disc adjacent to but spaced from said valve actuating disc;

spring means within the housing supported at one end on said intermediate disc and bearing against the inside surface of said top wall;

said plunger reciprocal within said openings and said valve actuating disc and intermediate disc retractable within said housing upon manual vertical movement of said plunger compressing said spring; and said means for maintaining said spring loaded plunger in compressed condition comprising horizontal foot-members at the ends of said levers, said horizontal foot-members movably positioned under said valve actuating disc to maintain said spring, valve actuating disc, intermediate disc and plunger in cocked position.

5. A fire extinguishing apparatus for oil wells as defined in claim 1, wherein:

said means for maintaining said spring loaded plungers in compressed condition comprising levers pivotally secured to the bracket means, said levers having handles at one end thereof and horizontal foot-members at the opposite ends thereof said foot-member extending across said open bottom and beneath said valve actuating disc.

6. A fire extinguishing apparatus for oil wells comprising:

a platform having a depending skirt therearound;

a plurality of containers secured to the platform;

a main container secured to the platform;

first valved conduits connecting the interior of the plurality of containers to the interior of the main container;

valve means on said main container;

second valved conduit means connected at one end to said valve means and at the opposite end to the interior of a bell nipple, said bell nipple attached to a blow out preventor of an oil well casing;

bracket means attached to said main container;

means attached to said bracket means for actuating said valve means whereby fire extinguishing material within the plurality of containers and within the main container flows under pressure through the first valved conduit means connecting the plurality of containers and the conduit means connecting the valve of the main container to the interior of the bell nipple for extinguishing a fire therein; and third valved conduit means attached at one end thereof to the interior of the bell nipple and at the opposite end to a source of fire extinguishing material under pressure at a remote location.

7. A fire extinguishing apparatus for oil wells as defined in claim 6, wherein:

said first valved conduits having valves therein at the ends thereof adjacent to said main container, said valves operable upon actuation of said valve means to permit fire extinguishing material contained in said plurality of containers to flow under pressure to said main container, through said valve means and second valved conduit to the interior of said bell nipple extinguishing a fire therein.

8. A fire extinguishing apparatus for oil wells as defined in claim 6, and:

said bracket means secured to said main container pivotally support levers for actuating said valve actuating means.

9. A fire extinguishing apparatus for oil wells comprising:

a platform having a depending skirt therearound;

a plurality of containers secured to the platform;

a main container secured to the platform;

valve conduits connecting each of said plurality of containers to said main container;

valve means in said main container having a valve actuating plunger reciprocal within said valve and having an end extending from the valve during inactive conditions;

valved conduit means connecting said valve means of said main container to the interior of a bell nipple attached to a blowout preventor of an oil well;

bracket means on said main container;

valve plunger actuating means positioned above and unconnected to said plunger of said valve means by said bracket means; and means for actuating said valve plunger actuating means whereby said plunger is depressed thus actuating said valve means whereby the contents of said plurality of containers and said main container flow through said valved conduit means into the interior of said bell nipple to extinguish a fire therein.

* * * * *